US009367073B2

(12) United States Patent
Tomioka et al.

(10) Patent No.: US 9,367,073 B2
(45) Date of Patent: Jun. 14, 2016

(54) VOLTAGE REGULATOR

(71) Applicant: Seiko Instruments Inc., Chiba-shi, Chiba (JP)

(72) Inventors: Tsutomu Tomioka, Chiba (JP); Masakazu Sugiura, Chiba (JP); Daisuke Yoshioka, Hamamatsu (JP); Hiroki Chuman, Hamamatsu (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 46 days.

(21) Appl. No.: 14/569,114

(22) Filed: Dec. 12, 2014

(65) Prior Publication Data

US 2015/0168970 A1 Jun. 18, 2015

(30) Foreign Application Priority Data

Dec. 18, 2013 (JP) ..... 2013-261384

(51) Int. Cl.
*G05F 1/565* (2006.01)
*G05F 1/56* (2006.01)
*G05F 1/567* (2006.01)

(52) U.S. Cl.
CPC . *G05F 1/56* (2013.01); *G05F 1/567* (2013.01)

(58) Field of Classification Search
CPC ..... G05F 1/46; G05F 1/461; G05F 1/462; G05F 1/56; G05F 1/563; G05F 1/565
USPC ..... 323/273, 274, 275, 279, 281
See application file for complete search history.

(56) References Cited

U.S. PATENT DOCUMENTS 4,553,098 A * 11/1985 Yoh ..... G05F 3/245 257/369
5,373,226 A * 12/1994 Kimura ..... G05F 3/245 323/313
6,831,505 B2 * 12/2004 Ozoe ..... G05F 3/262 323/313
7,459,895 B2 12/2008 Tokumitsu et al.

FOREIGN PATENT DOCUMENTS

JP 2006-127225 A 5/2006

* cited by examiner

*Primary Examiner* — Gary L Laxton
(74) *Attorney, Agent, or Firm* — Brinks Gilson & Lione

(57) ABSTRACT

Provided is a voltage regulator capable of preventing an output voltage from being increased even when a leakage current flows in an output transistor. The voltage regulator includes a leakage current control circuit. The leakage current control circuit includes an NMOS transistor connected to an output terminal of the voltage regulator. When the output voltage of the voltage regulator increases due to the leakage current of the output transistor, the leakage current control circuit causes the leakage current to flow through the NMOS transistor, to thereby prevent an increase in output voltage.

6 Claims, 7 Drawing Sheets

VOLTAGE REGULATOR

RELATED APPLICATIONS

This application claims priority under 35 U.S.C. §119 to Japanese Patent Application No. 2013-261384 filed on Dec. 18, 2013, the entire content of which is hereby incorporated by reference.

BACKGROUND OF THE INVENTION

1. Field of the Invention

The present invention relates to a voltage regulator including a leakage current control circuit configured to prevent an increase in output voltage caused by a leakage current of an output transistor.

2. Description of the Related Art

FIG. 7 is a circuit diagram illustrating a related-art voltage regulator.

The related-art voltage regulator includes PMOS transistors 103, 104, 106, 108, 111, and 121, NMOS transistors 105, 107, 109, 114, and 122, resistors 112 and 113, capacitors 801 and 802, a reference voltage circuit 131, a constant current circuit 110, a ground terminal 100, a power supply terminal 101, and an output terminal 102.

The PMOS transistors 103, 104, 106, and 108, the NMOS transistors 105, 107, 109, and 114, and the constant current circuit 110 form an error amplifier circuit.

The capacitor 801 directly feeds back an output voltage Vout of the output terminal 102 to the inside of the error amplifier circuit. With this configuration, a zero point fzcp is added in a high frequency region in frequency characteristics of the voltage regulator. Thus, a zero point fzfb can be set on the low frequency side, and hence a sufficient phase margin can be obtained even in a voltage regulator of three-stage amplification. Further, the setting of the zero point fzfb on the low frequency side can improve power supply rejection ratio (PSRR) characteristics as well. When the voltage regulator of three-stage amplification is configured in this way, a low equivalent series resistance (ESR) ceramic capacitor can be used for an output capacitor, to thereby obtain an output voltage Vout with a small ripple (see, for example, FIG. 10 of Japanese Patent Application Laid-open No. 2006-127225).

The related-art voltage regulator, however, has a problem in that, at high temperature and under a light load state in which a small load is connected to the output terminal 102, the output voltage Vout is increased due to a leakage current Ileak from the PMOS transistor 111.

SUMMARY OF THE INVENTION

The present invention has been made in view of the above-mentioned problem, and provides a voltage regulator capable of preventing an output voltage from being increased due to a leakage current under a light load state.

In order to solve the related-art problem, a voltage regulator according to one embodiment of the present invention has the following configuration.

The voltage regulator includes a leakage current control circuit. The leakage current control circuit includes an NMOS transistor connected to an output terminal of the voltage regulator. When an output voltage of the voltage regulator increases due to a leakage current of an output transistor, the leakage current control circuit causes the leakage current to flow through the NMOS transistor, to thereby prevent an increase in output voltage.

According to the voltage regulator of one embodiment of the present invention, the transistor is connected to the output terminal, and when the output voltage of the voltage regulator increases due to the leakage current under a light load state, the leakage current is caused to flow through the transistor. Consequently, the output voltage can be prevented from being increased.

DETAILED DESCRIPTION OF THE PREFERRED EMBODIMENTS

Now, embodiments of the present invention are described with reference to the drawings.

First Embodiment

Figure 1:
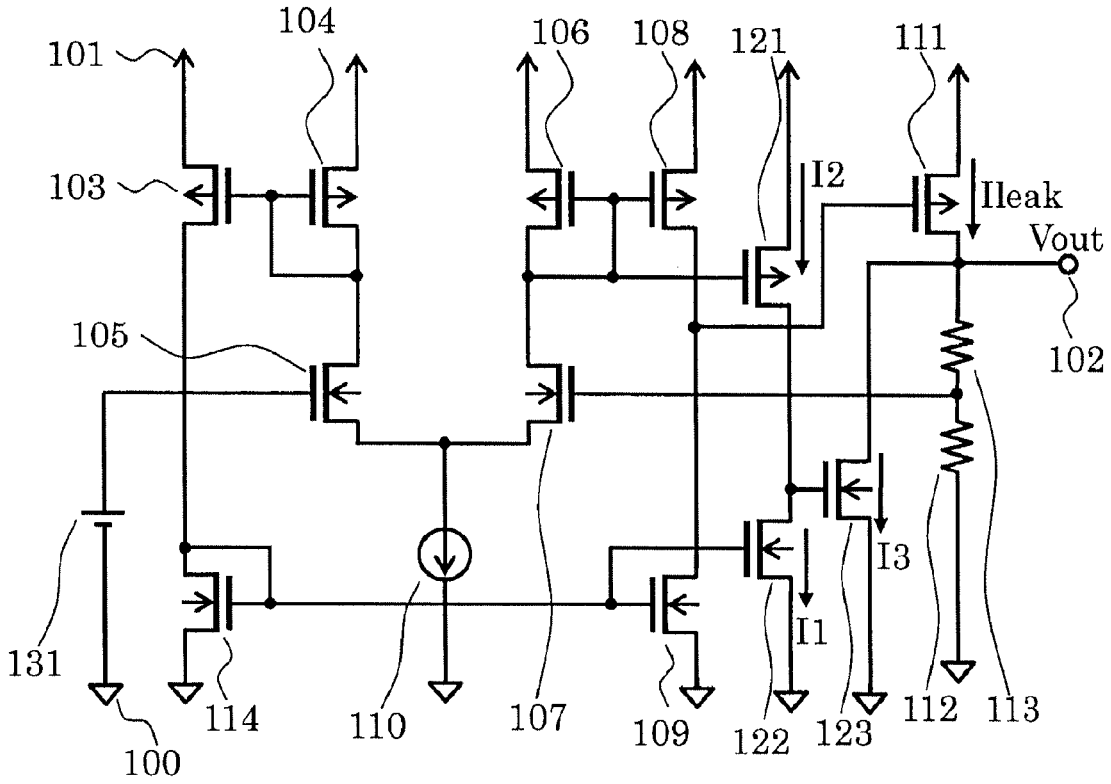
FIG. 1 is a circuit diagram illustrating a configuration of a voltage regulator according to a first embodiment of the present invention.

FIG. 1 is a circuit diagram of a voltage regulator according to a first embodiment of the present invention.

The voltage regulator of the first embodiment includes PMOS transistors 103, 104, 106, 108, 121, and 111, NMOS transistors 105, 107, 109, 114, 122, and 123, resistors 112 and 113, a reference voltage circuit 131, a constant current circuit 110, a ground terminal 100, a power supply terminal 101, and an output terminal 102. The PMOS transistors 103, 104, 106, and 108, the NMOS transistors 105, 107, 109, and 114, and the constant current circuit 110 form an error amplifier circuit. The PMOS transistor 121 and the NMOS transistors 123 and 122 form a leakage current control circuit.

Next, connections in the voltage regulator according to the first embodiment are described. The reference voltage circuit 131 has a positive terminal connected to a gate of the NMOS transistor 105 and a negative terminal connected to the ground terminal 100. The NMOS transistor 105 has a source connected to a source of the NMOS transistor 107 and a drain connected to a gate and a drain of the PMOS transistor 104. The PMOS transistor 104 has a source connected to the power supply terminal 101. The constant current circuit 110 has one terminal connected to the source of the NMOS transistor 105 and the other terminal connected to the ground terminal 100. The PMOS transistor 103 has a gate connected to the gate and the drain of the PMOS transistor 104, a drain connected to a gate and a drain of the NMOS transistor 114, and a source connected to the power supply terminal 101. The NMOS transistor 114 has a source connected to the ground terminal 100. The NMOS transistor 109 has a gate connected to the gate and the drain of the NMOS transistor 114, a drain connected to a drain of the PMOS transistor 108, and a source connected to the ground terminal 100. The PMOS transistor 108 has a gate connected to a gate and a drain of the PMOS transistor 106 and a source connected to the power supply terminal 101. The PMOS transistor 106 has a source connected to the power supply terminal 101. The NMOS transistor 107 has a gate connected to a connection point of one terminal of the resistor 113 and one terminal of the resistor 112, and a drain connected to the gate and the drain of the PMOS transistor 106. The other terminal of the resistor 113 is connected to the output terminal 102, and the other terminal of the resistor 112 is connected to the ground terminal 100. The PMOS transistor 121 has a gate connected to the gate of the PMOS transistor 108, a drain connected to a drain of the NMOS transistor 122, and a source connected to the power supply terminal 101. The NMOS transistor 122 has a gate connected to the gate of the NMOS transistor 109 and a source connected to the ground terminal 100. The NMOS transistor 123 has a gate connected to the drain of the NMOS transistor 122, a drain connected to the output terminal 102, and a source connected to the ground terminal 100. The PMOS transistor 111 has a gate connected to the drain of the PMOS transistor 108, a drain connected to the output terminal 102, and a source connected to the power supply terminal 101.

Next, an operation of the voltage regulator of the first embodiment is described. When the power supply terminal 101 inputs a power supply voltage VDD, the voltage regulator outputs an output voltage Vout from the output terminal 102. The resistors 112 and 113 divide the output voltage Vout and output a feedback voltage Vfb. The error amplifier circuit compares a reference voltage Vref of the reference voltage circuit 131 and the feedback voltage Vfb, and controls a gate voltage of the PMOS transistor 111, which operates as an output transistor, so that the output voltage Vout becomes constant.

When the output voltage Vout is higher than a predetermined value, the feedback voltage Vfb is higher than the reference voltage Vref. Therefore, an output signal of the error amplifier circuit (gate voltage of the PMOS transistor 111) becomes high to turn off the PMOS transistor 111 so that the output voltage Vout becomes low. On the other hand, when the output voltage Vout is lower than the predetermined value, operations reverse to the above-mentioned operations are performed so that the output voltage Vout becomes high. In this manner, the voltage regulator operates to control the output voltage Vout to be constant.

A current flowing through the PMOS transistor 121 is represented by 12, a current flowing through the NMOS transistor 122 is represented by Il, and a current flowing through the NMOS transistor 123 is represented by I3. When the voltage regulator operates so that the output voltage Vout may be constant, Vref≈Vfb is established, and a current flowing through the NMOS transistor 105 and a current flowing through the NMOS transistor 107 are equal to each other. The currents I2 and I1 obtained by returning the current of the NMOS transistor 105 and the NMOS transistor 107 are set so as to satisfy I1>I2, and then the gate of the NMOS transistor 123 becomes the ground level. Accordingly, the NMOS transistor 123 is turned off, and no current flows.

Now, a light load state in which a small load is connected to the output terminal 102 at high temperature is considered. A resistance value of the resistor 113 is represented by RF, a resistance value of the resistor 112 is represented by RS, and a resistance value of a load (not shown) connected to the output terminal 102 is represented by RL. When the temperature increases so that a leakage current Ileak is generated from the PMOS transistor 111, the leakage current Ileak flows through the resistors 112 and 113 and the load to generate a voltage. This voltage is expressed by Ileak×RL×(RF+RS)/(RL+RF+RS).

When the feedback voltage Vfb becomes higher than the reference voltage Vref, the error amplifier circuit increases the gate voltage of the PMOS transistor 111 to reduce an output current. When the feedback voltage Vfb becomes still higher than the reference voltage Vref, the error amplifier circuit turns off the PMOS transistor 111. However, when the leakage current Ileak is large under the high temperature state, the voltage of Ileak×RL×(RF+RS)/(RL+RF+RS) becomes higher than a desired output voltage Vout. In this state, the error amplifier circuit cannot control the output voltage Vout, and the output voltage Vout becomes higher than a desired voltage.

In this case, when the leakage current Ileak of the PMOS transistor 111 increases so that the feedback voltage Vfb becomes higher than the reference voltage Vref, the current flowing through the NMOS transistor 105 decreases, and the current flowing through the NMOS transistor 107 increases. Accordingly, when the current I1 decreases and the current I2 increases, the gate voltage of the NMOS transistor 123 increases, and the NMOS transistor 123 causes the current I3 to flow therethrough. The leakage current Ileak of the PMOS transistor 111 is extracted as the current I3 from the output terminal 102. Consequently, the leakage current Ileak does not flow through the resistors 112 and 113 and the load, and the increase in output voltage Vout can be suppressed.

Note that, when the output voltage Vout increases, because a negative feedback circuit for increasing the gate voltage of the NMOS transistor 123 to be higher than the output voltage Vout is formed, the output voltage Vout slightly higher than a target value is output due to the operation of the leakage current control circuit under the light load state at high temperature.

Further, the description of this embodiment is directed to the high temperature state, but the leakage current control circuit can be caused to operate as long as the leakage current Ileak is generated at the output transistor, and hence the increase in output voltage Vout can be suppressed even in other cases than the high temperature state.

As described above, in the voltage regulator according to the first embodiment, the NMOS transistor 123 is connected to the output terminal 102 so that the leakage current Ileak may flow through the NMOS transistor 123 when the output voltage Vout is increased due to the leakage current Ileak of the PMOS transistor 111. Consequently, the output voltage Vout can be prevented from being increased.

Figure 2:
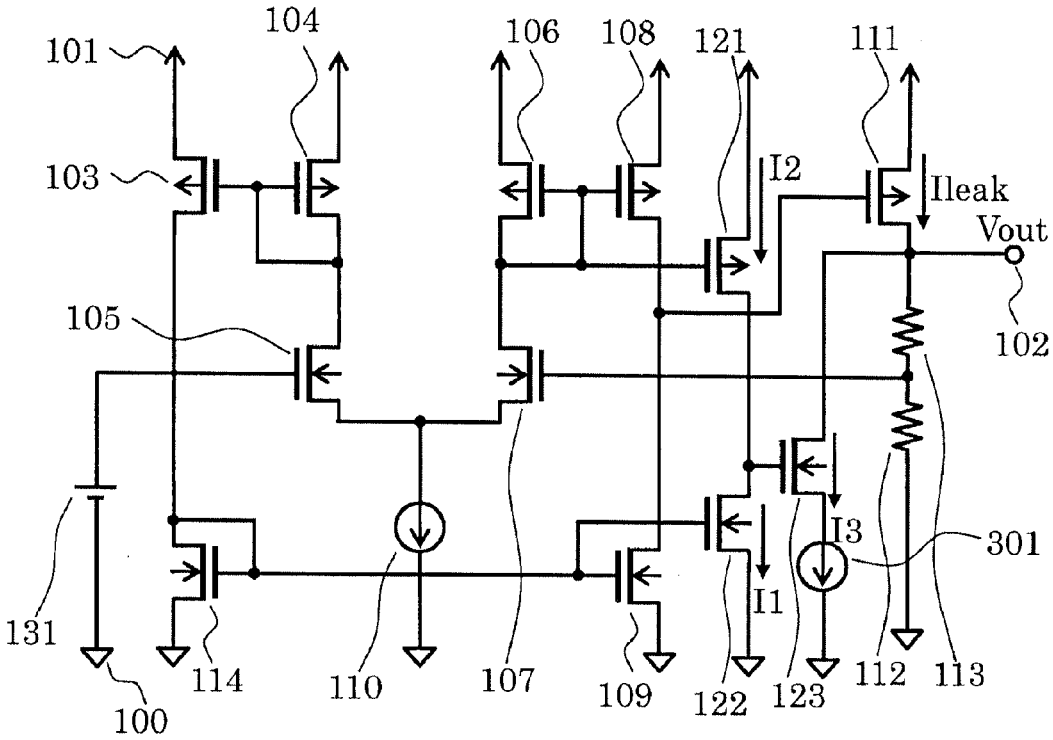
FIG. 2 is a circuit diagram illustrating another example of the voltage regulator according to the first embodiment.

FIG. 2 is a circuit diagram illustrating another example of the voltage regulator according to the first embodiment. FIG. 2 differs from FIG. 1 in that a constant current circuit 301 is added to the source of the NMOS transistor 123. With this configuration, the gain of the negative feedback circuit is reduced, and hence the negative feedback circuit can be prevented from oscillating. Consequently, a more stable voltage regulator can be constructed.

Figure 3:
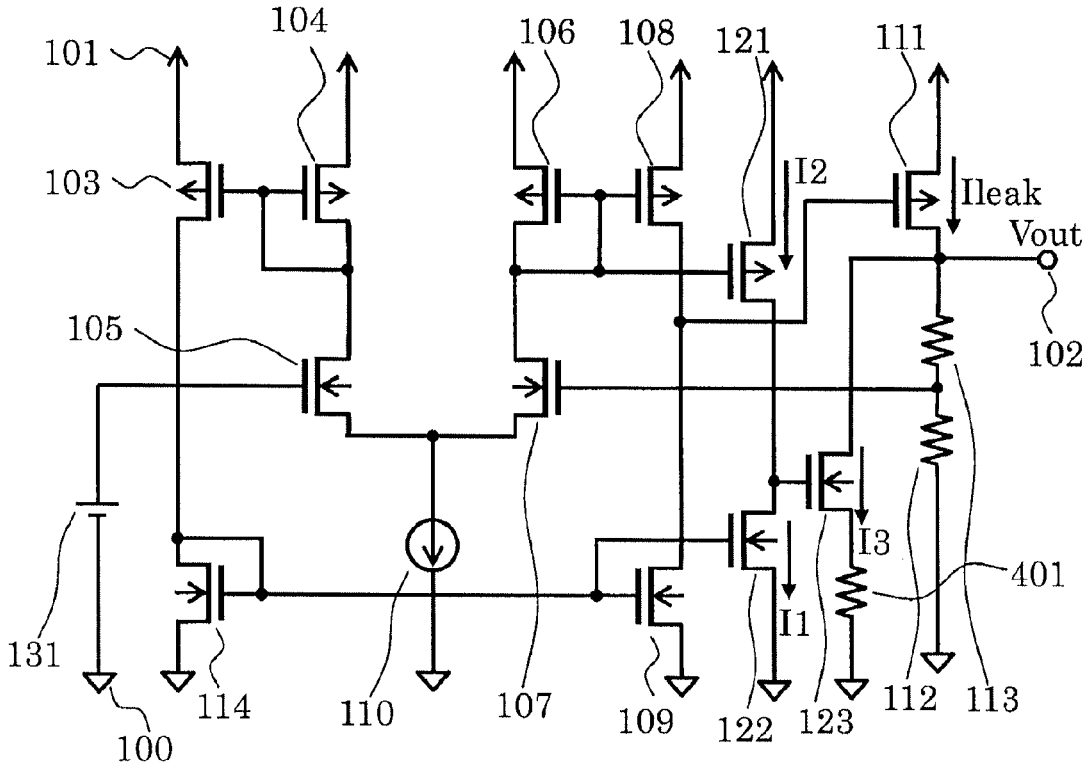
FIG. 3 is a circuit diagram illustrating another example of the voltage regulator according to the first embodiment.

FIG. 3 is a circuit diagram illustrating another example of the voltage regulator according to the first embodiment. Even when a resistor 401 is added to the source of the NMOS transistor 123 in this manner, the same effect can be obtained.

Second Embodiment

Figure 4:
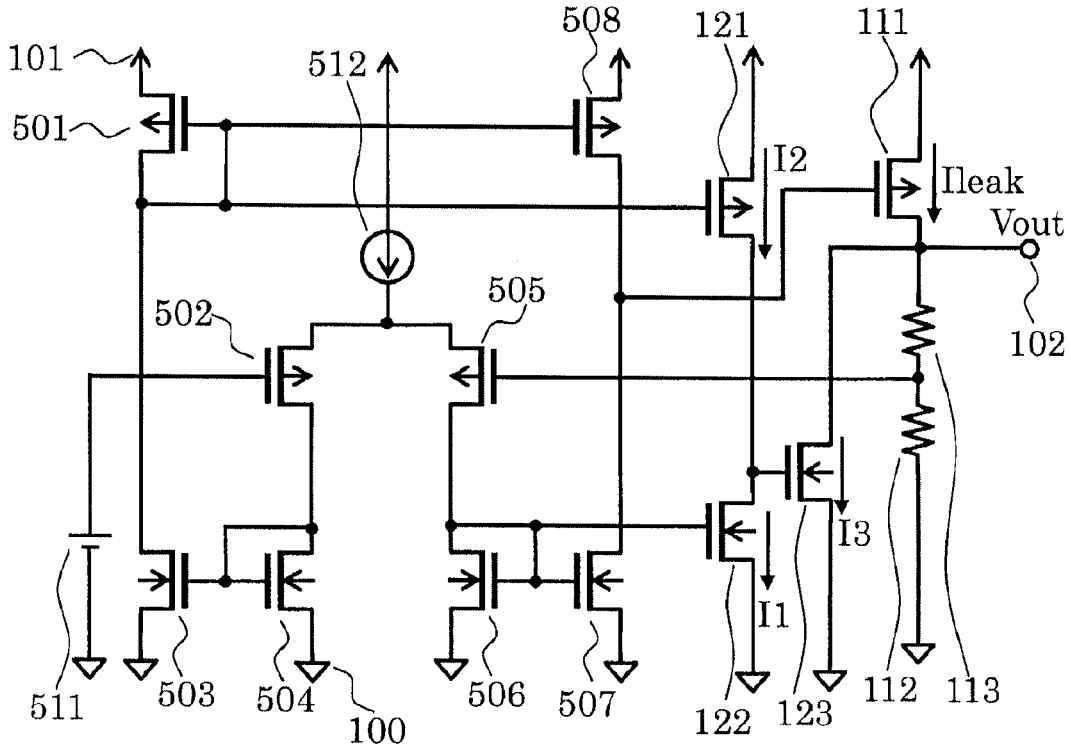
FIG. 4 is a circuit diagram illustrating a configuration of a voltage regulator according to a second embodiment of the present invention.

FIG. 4 is a circuit diagram of a voltage regulator according to a second embodiment of the present invention. The second embodiment differs from the first embodiment in that PMOS transistors are used for the input stage of the error amplifier circuit. The voltage regulator of the second embodiment includes PMOS transistors 501, 502, 505, 508, 121, and 111, NMOS transistors 503, 504, 506, 507, 122, and 123, resistors 112 and 113, a reference voltage circuit 511, a constant current circuit 512, a ground terminal 100, a power supply terminal 101, and an output terminal 102. The PMOS transistors 501, 502, 505, and 508, and the NMOS transistors 503, 504, 506, and 507, and the constant current circuit 512 form an error amplifier circuit. The PMOS transistor 121 and the NMOS transistors 123 and 122 form a leakage current control circuit.

Next, connections in the voltage regulator according to the second embodiment are described. The reference voltage circuit 511 has a positive terminal connected to a gate of the PMOS transistor 502 and a negative terminal connected to the ground terminal 100. The PMOS transistor 502 has a source connected to a source of the PMOS transistor 505 and a drain connected to a gate and a drain of the NMOS transistor 504. The NMOS transistor 504 has a source connected to the ground terminal 100. The constant current circuit 512 has one terminal connected to the source of the PMOS transistor 505 and the other terminal connected to the power supply terminal 101. The NMOS transistor 503 has a gate connected to the gate and the drain of the NMOS transistor 504, a drain connected to a gate and a drain of the PMOS transistor 501, and a source connected to the ground terminal 100. The PMOS transistor 501 has a source connected to the power supply terminal 101. The PMOS transistor 508 has a gate connected to the gate and the drain of the PMOS transistor 501, a drain connected to a drain of the NMOS transistor 507, and a source connected to the power supply terminal 101. The NMOS transistor 507 has a gate connected to a gate and a drain of the NMOS transistor 506 and a source connected to the ground terminal 100. The NMOS transistor 506 has a source connected to the ground terminal 100. The PMOS transistor 505 has a gate connected to a connection point of one terminal of the resistor 113 and one terminal of the resistor 112, and a drain connected to the gate and the drain of the NMOS transistor 506. The other terminal of the resistor 113 is connected to the output terminal 102, and the other terminal of the resistor 112 is connected to the ground terminal 100. The PMOS transistor 121 has a gate connected to the gate and the drain of the PMOS transistor 501, a drain connected to a drain of the NMOS transistor 122, and a source connected to the power supply terminal 101. The NMOS transistor 122 has a gate connected to the gate of the NMOS transistor 507 and a source connected to the ground terminal 100. The NMOS transistor 123 has a gate connected to the drain of the NMOS transistor 122, a drain connected to the output terminal 102, and a source connected to the ground terminal 100. The PMOS transistor 111 has a gate connected to the drain of the PMOS transistor 508, a drain connected to the output terminal 102, and a source connected to the power supply terminal 101.

Next, an operation of the voltage regulator of the second embodiment is described. When the power supply terminal 101 inputs a power supply voltage VDD, the voltage regulator outputs an output voltage Vout from the output terminal 102. The resistors 112 and 113 divide the output voltage Vout and output a feedback voltage Vfb. The error amplifier circuit compares a reference voltage Vref of the reference voltage circuit 511 and the feedback voltage Vfb, and controls a gate voltage of the PMOS transistor 111, which operates as an output transistor, so that the output voltage Vout becomes constant.

When the output voltage Vout is higher than a predetermined value, the feedback voltage Vfb is higher than the reference voltage Vref. Therefore, an output signal of the error amplifier circuit (gate voltage of the PMOS transistor 111) becomes high to turn off the PMOS transistor 111 so that the output voltage Vout becomes low. On the other hand, when the output voltage Vout is lower than the predetermined value, operations reverse to the above-mentioned operations are performed so that the output voltage Vout becomes high. In this manner, the voltage regulator operates to control the output voltage Vout to be constant.

A current flowing through the PMOS transistor 121 is represented by I2, a current flowing through the NMOS transistor 122 is represented by I1, and a current flowing through the NMOS transistor 123 is represented by I3. When the voltage regulator operates so that the output voltage Vout may be constant, Vref≈Vfb is established, and a current flowing through the PMOS transistor 502 and a current flowing through the PMOS transistor 505 are equal to each other. The currents I2 and I1 obtained by returning the current of the PMOS transistor 502 and the PMOS transistor 505 are set so as to satisfy I1>I2, and then the gate of the NMOS transistor 123 becomes the ground level. Accordingly, the NMOS transistor 123 is turned off, and no current flows.

Now, a light load state in which a small load is connected to the output terminal 102 at high temperature is considered. A resistance value of the resistor 113 is represented by RF, a resistance value of the resistor 112 is represented by RS, and a resistance value of a small load (not shown) connected to the output terminal 102 is represented by RL. When the temperature increases so that a leakage current Ileak is generated from the PMOS transistor 111, the leakage current Ileak flows through the resistors 112 and 113 and the load to generate a voltage. This voltage is expressed by Ileak×RL×(RF+RS)/(RL+RF+RS).

When the feedback voltage Vfb becomes higher than the reference voltage Vref, the error amplifier circuit increases the gate voltage of the PMOS transistor 111 to reduce an output current. When the feedback voltage Vfb becomes still higher than the reference voltage Vref, the error amplifier circuit turns off the PMOS transistor 111. However, when the leakage current Ileak is large under the high temperature state, the voltage of Ileak×RL×(RF+RS)/(RL+RF+RS) becomes higher than a desired output voltage Vout. In this state, the error amplifier circuit cannot control the output voltage Vout, and the output voltage Vout becomes higher than a desired voltage. In this case, when the leakage current Ileak of the PMOS transistor 111 increases so that the feedback voltage Vfb becomes higher than the reference voltage Vref, the current flowing through the NMOS transistor 105 decreases, and the current flowing through the NMOS transistor 107 increases. Accordingly, when the current I1 decreases and the current I2 increases, the gate voltage of the NMOS transistor 123 increases, and the NMOS transistor 123 causes the current I3 to flow therethrough. The leakage current Ileak of the PMOS transistor 111 is extracted as the current I3 from the output terminal 102. Consequently, the leakage current Ileak does not flow through the resistors 112 and 113 and the load, and the increase in output voltage Vout can be suppressed.

Note that, when the output voltage Vout increases, because a negative feedback circuit for increasing the gate voltage of the NMOS transistor 123 to be higher than the output voltage Vout is formed, the output voltage Vout slightly higher than a target value is output due to the operation of the leakage current control circuit under the light load state at high temperature.

Further, the description of this embodiment is directed to the high temperature state, but the leakage current control circuit can be caused to operate as long as the leakage current Ileak is generated at the output transistor, and hence the increase in output voltage Vout can be suppressed even in other cases than the high temperature state.

As described above, in the voltage regulator according to the second embodiment, the NMOS transistor 123 is connected to the output terminal 102 so that the leakage current Ileak may flow through the NMOS transistor 123 when the output voltage Vout is increased due to the leakage current Ileak of the PMOS transistor 111. Consequently, the output voltage Vout can be prevented from being increased.

Figure 5:
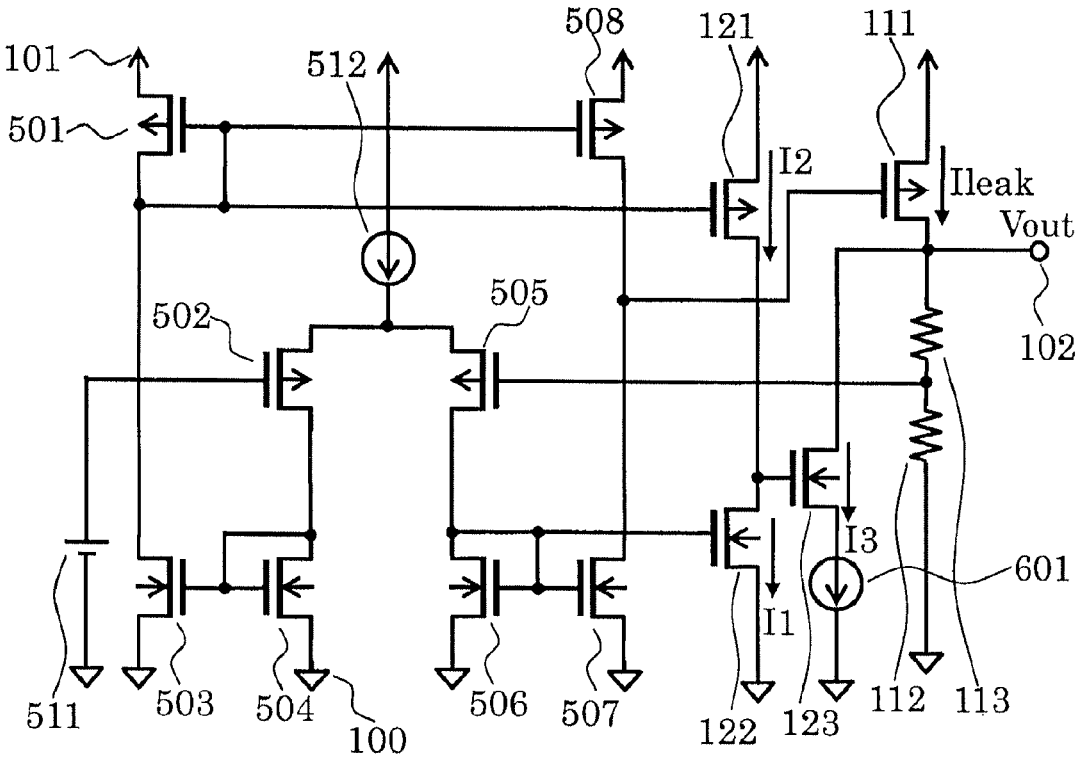
FIG. 5 is a circuit diagram illustrating another example of the voltage regulator according to the second embodiment.

FIG. 5 is a circuit diagram illustrating another example of the voltage regulator according to the second embodiment. FIG. 5 differs from FIG. 4 in that a constant current circuit 601 is added to the source of the NMOS transistor 123. With this configuration, the gain of the negative feedback circuit is reduced, and hence the negative feedback circuit can be prevented from oscillating. Consequently, a more stable voltage regulator can be constructed.

Figure 6:
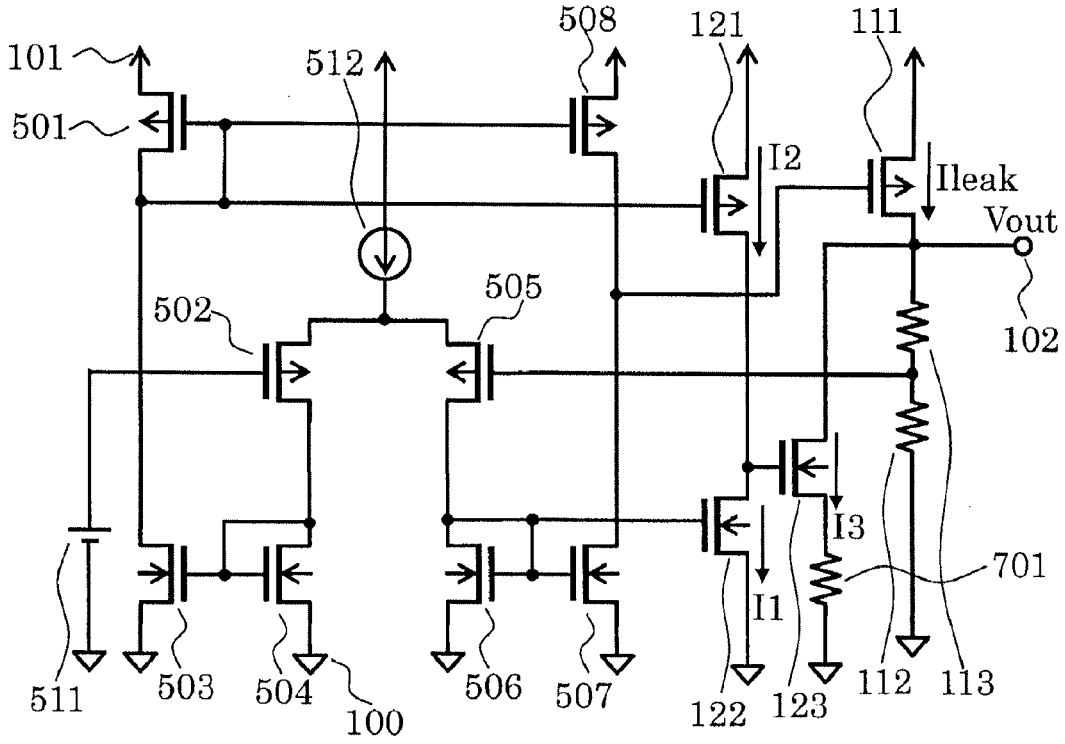
FIG. 6 is a circuit diagram illustrating another example of the voltage regulator according to the second embodiment.
Figure 7:
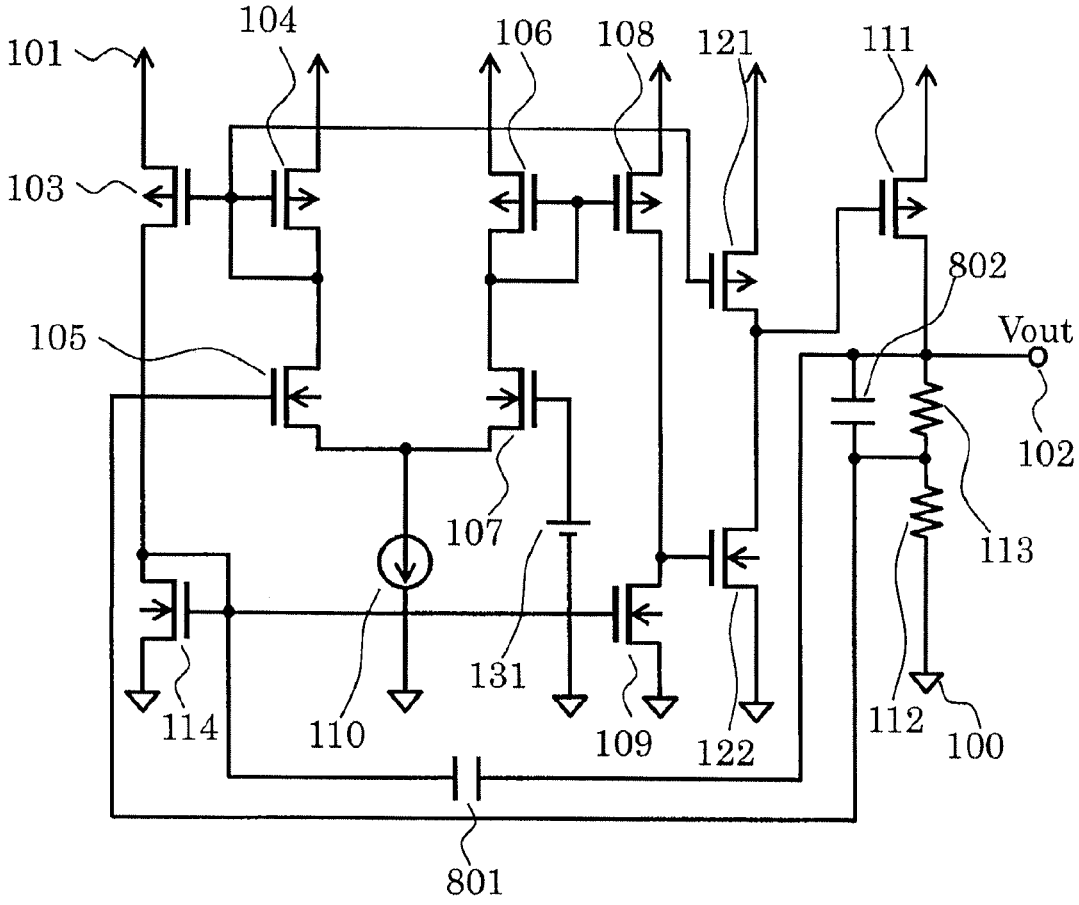
FIG. 7 PRIOR ART
FIG. 7 is a circuit diagram illustrating a configuration of a related-art voltage regulator.

FIG. 6 is a circuit diagram illustrating another example of the voltage regulator according to the second embodiment. Even when a resistor 701 is added to the source of the NMOS transistor 123 in this manner, the same effect can be obtained.

What is claimed is:

1. A voltage regulator, comprising:

an output transistor configured to output an output voltage;

an error amplifier circuit configured to amplify a difference between a divided voltage obtained by dividing the output voltage and a reference voltage to output the amplified difference, to thereby control a gate of the output transistor; and a leakage current control circuit including an input terminal connected to the error amplifier circuit and an output terminal connected to a drain of the output transistor, the leakage current control circuit being configured to prevent, when the output voltage is increased due to a leakage current generated at the output transistor, an increase in the output voltage by extracting the leakage current.

2. A voltage regulator according to claim 1, wherein the leakage current control circuit comprises:

a first transistor including a gate connected to the error amplifier circuit, the first transistor being configured to detect an increase in the leakage current;

a second transistor including a gate connected to the error amplifier circuit and a drain connected to a drain of the first transistor, the second transistor being configured to detect the increase in the leakage current; and a third transistor including a gate connected to the drain of the first transistor and a drain connected to the drain of the output transistor, the third transistor being configured to cause the leakage current to flow.

3. A voltage regulator according to claim 2, wherein the leakage current control circuit further comprises a first constant current circuit connected to a source of the third transistor.

4. A voltage regulator according to claim 2, wherein the leakage current control circuit further comprises a resister connected to a source of the third transistor.

5. A voltage regulator according to claim 2, wherein the error amplifier circuit comprises:

a first NMOS transistor including a gate to which the reference voltage is input;

a first PMOS transistor including a gate and a drain that are connected to a drain of the first NMOS transistor, and a source connected to the power supply terminal;

a second PMOS transistor including a gate connected to the gate and the drain of the first PMOS transistor, and a source connected to the power supply terminal;

a second NMOS transistor including a gate and a drain that are connected to a drain of the second PMOS transistor, and a source connected to a ground terminal;

a third NMOS transistor including a gate connected to the gate and the drain of the second NMOS transistor and the gate of the first transistor, and a source connected to the ground terminal;

a third PMOS transistor including a drain connected to a drain of the third NMOS transistor and the gate of the output transistor, and a source connected to the power supply terminal;

a fourth PMOS transistor including a gate and a drain that are connected to a gate of the third PMOS transistor and the gate of the second transistor, and a source connected to the power supply terminal;

a fourth NMOS transistor including a gate to which the divided voltage is input, and a drain connected to the gate and the drain of the fourth PMOS transistor; and a second constant current circuit connected to the source of the first NMOS transistor and the source of the fourth NMOS transistor.

6. A voltage regulator according to claim 2, wherein the error amplifier circuit comprises:

a first PMOS transistor including a gate to which the reference voltage is input;

a first NMOS transistor including a gate and a drain that are connected to a drain of the first PMOS transistor, and a source connected to the ground terminal;

a second NMOS transistor including a gate connected to the gate and the drain of the first NMOS transistor, and a source connected to the ground terminal;

a second PMOS transistor including a gate and a drain that are connected to a drain of the second NMOS transistor, and a source connected to a power supply terminal;

a third PMOS transistor including a gate connected to the gate and the drain of the second PMOS transistor and the gate of the second transistor, and a source connected to the power supply terminal;

a third NMOS transistor including a drain connected to a drain of the third PMOS transistor and the gate of the output transistor, and a source connected to the ground terminal;

a fourth NMOS transistor including a gate and a drain that are connected to a gate of the third NMOS transistor and the gate of the first transistor, and a source connected to the ground terminal;

a fourth PMOS transistor including a gate to which the divided voltage is input, and a drain connected to the gate and the drain of the fourth NMOS transistor; and a second constant current circuit connected to the source of the first PMOS transistor and the source of the fourth PMOS transistor.

* * * * *